US012072127B2

(12) United States Patent
Guo et al.

(10) Patent No.: US 12,072,127 B2
(45) Date of Patent: Aug. 27, 2024

(54) REFRIGERATION SYSTEM AND OIL RECOVERY METHOD FOR THE SAME

(71) Applicant: Carrier Corporation, Palm Beach Gardens, FL (US)

(72) Inventors: Zhen Guo, Shanghai (CN); Kai Deng, Shanghai (CN); Vishnu Sishtla, Palm Beach Gardens, FL (US); Yingqin Wu, Shanghai (CN); Lei Yu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/834,052

(22) Filed: Jun. 7, 2022

(65) Prior Publication Data

US 2022/0404077 A1 Dec. 22, 2022

(30) Foreign Application Priority Data

Jun. 17, 2021 (CN) ..... 202110672368.2

(51) Int. Cl.
*F25B 41/20* (2021.01)
*F25B 31/00* (2006.01)
(Continued)

(52) U.S. Cl.
CPC ..... *F25B 43/02* (2013.01); *F25B 31/004* (2013.01); *F25B 41/20* (2021.01); *F25B 49/02* (2013.01); *F25B 2500/16* (2013.01)

(58) Field of Classification Search
CPC ..... F25B 43/02; F25B 41/20; F25B 31/004; F25B 49/02; F25B 2500/16
See application file for complete search history.

(56) References Cited

U.S. PATENT DOCUMENTS 3,766,747 A * 10/1973 Parker ..... F04B 49/10 417/279
4,058,988 A 11/1977 Shaw
(Continued)

FOREIGN PATENT DOCUMENTS

CN 2435520 Y 6/2001
CN 102032145 A 4/2011
(Continued)

OTHER PUBLICATIONS

Meuser, Method for operating thermal power plant . . . , 2011, Full Document (Year: 2011).*
(Continued)

*Primary Examiner* — Nael N Babaa
(74) *Attorney, Agent, or Firm* — CANTOR COLBURN LLP

(57) ABSTRACT

A refrigeration system includes a compressor, a condenser, a throttling device, and an evaporator, which are connected in sequence to form a cooling circuit, the refrigeration system further includes an oil recovery system which includes: an operation chamber, which includes a first port communicating with an oil-containing position in the refrigeration system through a first pipeline, and a second port communicating with a bearing chamber or a bearing lubrication pipeline of the compressor through a second pipeline; and a main piston in the operation chamber, the main piston reciprocating in the operation chamber to perform an extraction stroke and a discharge stroke; in the extraction stroke, an oil-containing refrigerant in the oil-containing position in the refrigeration system is extracted to the operation chamber; and in the discharge stroke, the oil-containing refrigerant in the operation chamber is delivered to the bearing chamber or the bearing lubrication pipeline of the compressor.

8 Claims, 3 Drawing Sheets

(51) Int. Cl.
*F25B 43/02* (2006.01)
*F25B 49/02* (2006.01)

(56) References Cited

U.S. PATENT DOCUMENTS

| | | | | |
|---|---|---|---|---|
| 4,249,866 | A | 2/1981 | Shaw et al. | |
| 4,412,788 | A | 11/1983 | Shaw et al. | |
| 4,932,844 | A | 6/1990 | Glanwall | |
| 6,176,092 | B1 | 1/2001 | Butterworth et al. | |
| 6,526,765 | B2 | 3/2003 | Lifson | |
| 6,739,139 | B1 | 5/2004 | Solomon | |
| 9,541,312 | B2 | 1/2017 | Woolley et al. | |
| 10,317,121 | B2 | 6/2019 | Johnson | |
| 10,527,050 | B2 | 1/2020 | Sishtla | |
| 2002/0078697 | A1 | 6/2002 | Lifson | |
| 2002/0162352 | A1 | 11/2002 | Ring et al. | |
| 2014/0360210 | A1 | 12/2014 | Lapp et al. | |
| 2018/0231006 | A1 | 8/2018 | Sun | |
| 2021/0278095 | A1 * | 9/2021 | Song | F25B 41/325 |

FOREIGN PATENT DOCUMENTS

| | | | | |
|---|---|---|---|---|
| CN | 201843746 | U | 5/2011 | |
| CN | 102155429 | A | 8/2011 | |
| CN | 102734158 | A | 10/2012 | |
| DE | 102011103613 | A1 * | 12/2012 | F01K 23/10 |
| EP | 2251621 | A1 | 11/2010 | |
| WO | 2020120064 | A1 | 4/2020 | |
| WO | 2020134520 | A | 7/2020 | |

OTHER PUBLICATIONS

European Search Report for application EP 22179601 dated Oct. 28, 2022, 78 pages.

* cited by examiner

REFRIGERATION SYSTEM AND OIL RECOVERY METHOD FOR THE SAME

FOREIGN PRIORITY

This application claims priority to Chinese Patent Application No. 202110672368.2, filed Jun. 17, 2021, and all the benefits accruing therefrom under 35 U.S.C. § 119, the contents of which in its entirety are herein incorporated by reference.

TECHNICAL FIELD OF INVENTION

The present disclosure relates to a refrigeration system; more specifically, the present disclosure relates to an oil recovery device and an oil recovery method in a refrigeration system.

BACKGROUND OF THE INVENTION

In a refrigeration system, components (such as bearings) of compressor need to be lubricated by oil. In a substantially oil-free compressor, the refrigeration system itself is not provided with an oil separator, and the system delivers a liquid refrigerant in a condenser to a bearing chamber or bearing lubrication pipeline of the compressor. Due to the characteristics of lubricating oil, it will not accumulate in the condenser, but will accumulate at bottom of an evaporator and bottom of an inner shell of the compressor. In order to improve the reliability of the bearings in the compressor, this oil-rich refrigerant (also called gas-liquid two-phase refrigerant) needs to be delivered to the bearing chamber or bearing lubrication pipeline of the compressor. In this type of system, there are certain requirements for the amount and pressure of the returned refrigerant to ensure that enough oil can reach positions of the bearing chamber or bearing lubrication pipeline of the compressor where lubrication is desired.

SUMMARY OF THE INVENTION

An object of the present disclosure is to solve or at least alleviate the problems existing in the prior art.

According to an aspect, a refrigeration system is provided, which includes: a compressor, a condenser, a throttling device, and an evaporator, all of which are connected in sequence to form a cooling circuit, in which the refrigeration system further includes an oil recovery system which includes: an operation chamber, which includes a first port communicating with an oil-containing position in the refrigeration system through a first pipeline, and a second port communicating with a bearing chamber or a bearing lubrication pipeline of the compressor through a second pipeline; and a main piston in the operation chamber, the main piston reciprocating in the operation chamber to perform an extraction stroke and a discharge stroke; in the extraction stroke, an oil-containing refrigerant in the oil-containing position in the refrigeration system is extracted to the operation chamber; and in the discharge stroke, the oil-containing refrigerant in the operation chamber is delivered to the bearing chamber or the bearing lubrication pipeline of the compressor.

Optionally, in an embodiment of the refrigeration system, the oil-containing position in the refrigeration system is in an oil-collecting cavity inside the compressor or in the evaporator.

Optionally, in an embodiment of the refrigeration system, a first one-way valve that only allows a fluid to flow from the oil-containing position to the first port is provided on the first pipeline or on an end cover at an end of the operation chamber, and a second one-way valve that only allows the fluid to flow from the second port to the bearing chamber or the bearing lubrication pipeline of the compressor is provided on the second pipeline or the end cover.

Optionally, in an embodiment of the refrigeration system, the main piston is driven by an electric actuator.

Optionally, in an embodiment of the refrigeration system, the main piston is connected to a first side of a control piston through a connecting rod, there is a first control chamber at the first side of the control piston and a second control chamber at a second side of the control piston; the first control chamber and the second control chamber are alternatively connected to a first pressure fluid source and a second pressure fluid source, and there is a sufficient pressure difference between the first pressure fluid source and the second pressure fluid source, thereby driving the control piston to reciprocate together with the main piston to perform the extraction stroke and the discharge stroke.

Optionally, in an embodiment of the refrigeration system, the first control chamber is located between a back side of the main piston and the first side of the control piston, and the control piston has a larger area of action than the main piston.

Optionally, in an embodiment of the refrigeration system, the first pressure fluid source is from the evaporator, and the second pressure fluid source is from the condenser.

Optionally, in an embodiment of the refrigeration system, the evaporator is connected to the first control chamber through a first valve and is connected to the second control chamber through a second valve, and the condenser is connected to the first control chamber through a third valve and is connected to the second control chamber through a fourth valve; or the evaporator is connected to the first control chamber and the second control chamber respectively through a first three-way valve, and the condenser is connected to the first control chamber and the second control chamber respectively through a second three-way valve; or the evaporator, the condenser, the first control chamber and the second control chamber are connected through a four-way valve.

Optionally, in an embodiment of the refrigeration system, the refrigeration system further includes: a sensor, which is configured to sense a position of the control piston or the main piston; and a controller in communication with the sensor, which is configured to operate at least one valve based on the position of the control piston or the main piston provided by the sensor so that the first control chamber and the second control chamber are alternatively connected to the first pressure fluid source and the second pressure fluid source.

Optionally, in an embodiment of the refrigeration system, the oil recovery system further includes an additional operation chamber, and the additional operation chamber includes a first port communicating with the oil-containing position in the refrigeration system through a third pipeline, and a second port communicating with the bearing chamber or the bearing lubrication pipeline of the compressor through a fourth pipeline; and an additional main piston in the additional operation chamber, in which the additional main piston is connected to the second side of the control piston through a connecting rod, the second control chamber is located between a back side of the additional main piston and the second side of the control piston, and the control piston has a larger area of action than the additional main piston; when the main piston is performing the extraction stroke, the additional main piston performs the discharge stroke to deliver the oil-containing refrigerant from the additional operation chamber to the bearing chamber or the bearing lubrication pipeline of the compressor, and when the main piston is performing the discharge stroke, the additional main piston performs the extraction stroke to extract the oil-containing refrigerant in the oil-containing position in the refrigeration system to the additional operation chamber.

According to another aspect, an oil recovery method for a refrigeration system is also provided, which includes: driving a main piston in an operation chamber to move by using an electric actuator or a pressure difference between a first pressure fluid source and a second pressure fluid source in the refrigeration system so as to extract an oil-containing refrigerant in an oil-containing position in the refrigeration system to the operation chamber; and driving the main piston in the operation chamber to move by using the electric actuator or the pressure difference between the first pressure fluid source and the second pressure fluid source in the refrigeration system so as to deliver the oil-containing refrigerant in the operation chamber to a bearing chamber or a bearing lubrication pipeline of a compressor.

The device and method according to the embodiments of the present disclosure can provide refrigerant with sufficient oil content to the bearing chamber or the bearing lubrication pipeline of the compressor.

BRIEF DESCRIPTION OF THE DRAWINGS

With reference to the accompanying drawings, the content of the present disclosure will become easier to understand. It can be easily understood by those skilled in the art that these drawings are only for illustrative purpose, and are not intended to limit the scope of protection of the present disclosure. In addition, similar numbers in the drawings are used to denote similar components, in which.

DETAILED DESCRIPTION OF THE INVENTION

Figure 1:
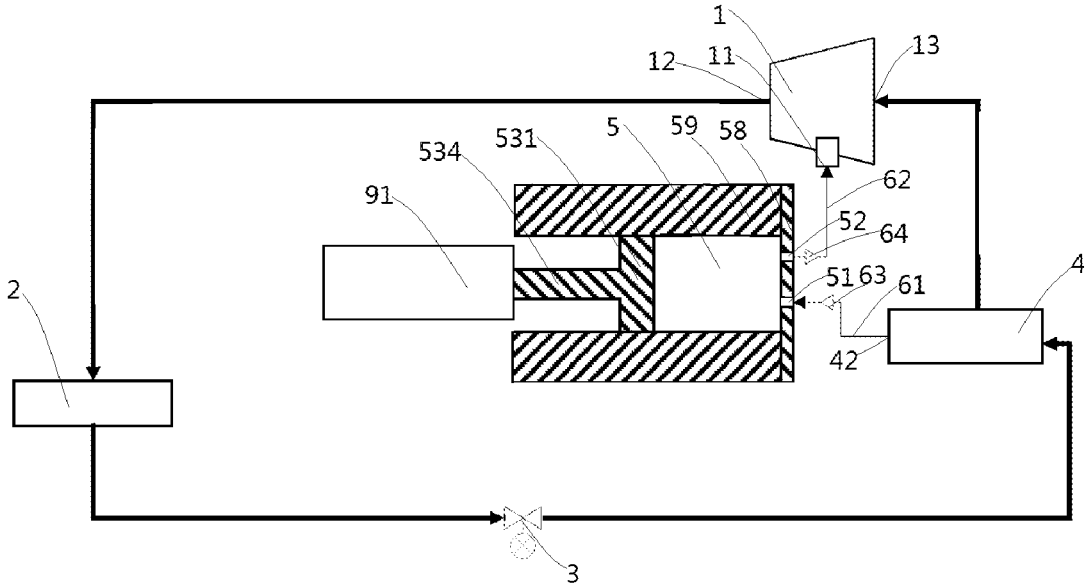
FIG. 1 shows a schematic structural view of a refrigeration system according to an embodiment of the present disclosure.

First, referring to FIG. 1, the structure of a refrigeration system according to an embodiment of the present disclosure will be introduced. The refrigeration system includes: a compressor 1, a condenser 2, a throttling device 3, and an evaporator 4, all of which are connected in sequence to form a cooling circuit. The compressor 1 includes a compressor inlet 13, a compressor outlet 12 and a bearing chamber or bearing lubrication pipeline 11 of the compressor. The compressor outlet 12 is connected to the condenser 2 through a pipeline, and the condenser 2 is connected to the throttling device 3 through a pipeline. The throttling device 3 is, for example, an expansion valve, and the throttling device 3 is connected to the evaporator 4. Finally, the evaporator 4 is connected to the compressor inlet 13 to form the cooling circuit. In the refrigeration system according to the embodiment of the present disclosure, the compressor 1 may be an oil-free or substantially oil-free compressor, and the compressor 1 itself does not include an oil circuit. Therefore, the refrigeration system is also provided with an oil recovery system. The oil recovery system includes: an operation chamber 5, which includes a first port 51 and a second port 52, in which the first port 51 communicates with an oil-containing position in the refrigeration system through a first pipeline 61, and the second port 52 communicates with the bearing chamber or bearing lubrication pipeline 11 of the compressor 1 through a second pipeline 62. In the illustrated embodiment, the operation chamber 5 is defined by a cylinder 59 and an end cover 58 at one end of the cylinder 59, and the end cover 58 is provided with a first port 51 and a second port 52. A main piston 531 is arranged in the operation chamber 5, and the main piston 531 reciprocates in the operation chamber to perform an extraction stroke and a discharge stroke. In the extraction stroke, an oil-containing refrigerant in the oil-containing position in the refrigeration system is extracted to the operation chamber 5. In the discharge stroke, the oil-containing refrigerant in the operation chamber 5 is delivered to the bearing chamber or bearing lubrication pipeline 11 of the compressor, thereby delivering the refrigerant with a certain oil concentration and pressure to the bearing chamber or bearing lubrication pipeline 11 of the compressor for lubrication, anti-corrosion protection and cooling. It should be understood that as the main piston 531 reciprocates, the above-mentioned extraction stroke and discharge stroke are repeated at a certain cycle. In the illustrated embodiment, the first port 51 of the operation chamber 5 is connected to a port 42 of the evaporator 4 through the first pipeline 61. The port 42 may be an additional port of the evaporator 4, and is not an inlet or outlet of the evaporator 4 which is connected to the throttling device 3 or the compressor inlet 13. In some embodiments, the port 42 of the evaporator 4 may be located at bottom of the evaporator 4 so as to recover the oil-rich refrigerant (also called gas-liquid two-phase refrigerant) at the bottom of the evaporator to the compressor 1. The so-called extraction stroke refers to a stroke in which the main piston 531 moves toward the left to extract the refrigerant in the evaporator 4 into the operation chamber 5, and the so-called discharge stroke refers to a stroke in which the main piston 531 moves toward the right to discharge the refrigerant in the operation chamber 5 to the bearing chamber or bearing lubrication pipeline of the compressor.

The oil-containing position refers to a position in the refrigeration system where there is a refrigerant with a certain oil concentration. Although in the illustrated embodiment, the interior of the evaporator 4 is used as a specific example of the oil-containing position, it should be understood that there are more options for the oil-containing position in the refrigeration system, such as at an oil-collecting cavity inside the compressor 1, at an economizer (if exists) of the refrigeration system or other evaporators, etc., as long as there is a refrigerant with a certain oil concentration at that position.

In some embodiments, the first pipeline 61 or the first port 51 is provided with a first one-way valve 63 that only allows fluid to flow from the oil-containing position (that is, the interior of the evaporator 4) to the first port 51 of the operation chamber 5, and the second pipeline 62 or the second port 52 is provided with a second one-way valve 64 that only allows fluid to flow from the second port 52 of the operation chamber 5 to the bearing chamber or bearing lubrication pipeline 11 of the compressor 1, so that a reverse flow of the refrigerant fluid can be avoided. In an alternative embodiment, valves that can be opened and closed, such as solenoid valves, may be provided on the first pipeline 61 and the second pipeline 62, in which the valve on the first pipeline is opened and the valve on the second pipeline is closed during the extraction stroke, whereas the valve on the second pipeline is opened and the valve on the first pipeline is closed during the discharge stroke. In the embodiment of FIG. 1, the main piston 531 is connected to an electric actuator 91 through the connecting rod 534, and is therefore driven by the electric actuator 91 to perform the extraction stroke and the discharge stroke. The electric actuator 91 may be, for example, a linear motor or the like.

Figure 2:
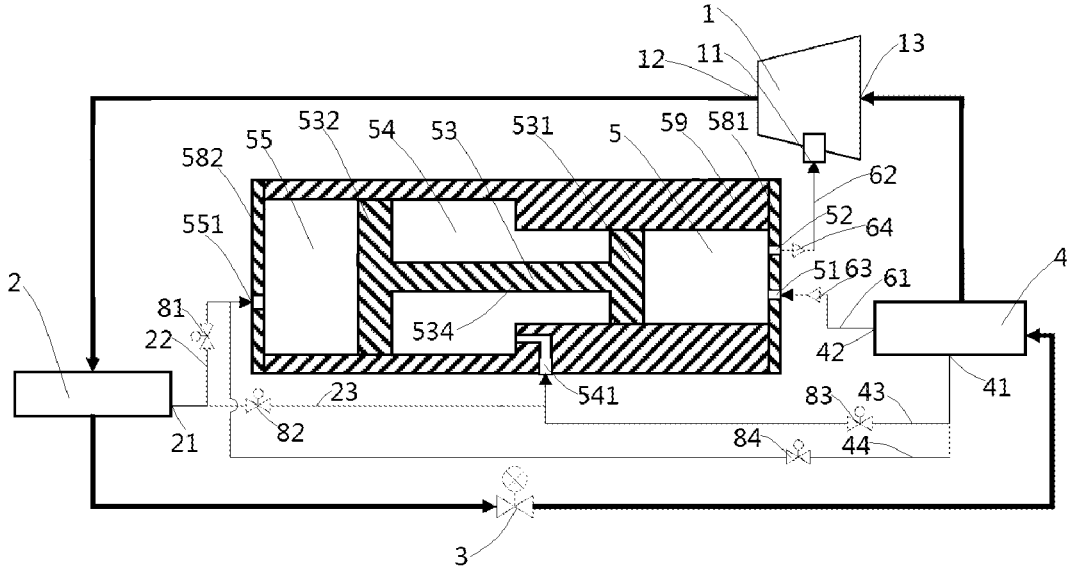
FIG. 2 shows a schematic structural view of a refrigeration system according to another embodiment of the present disclosure.
Figure 3:
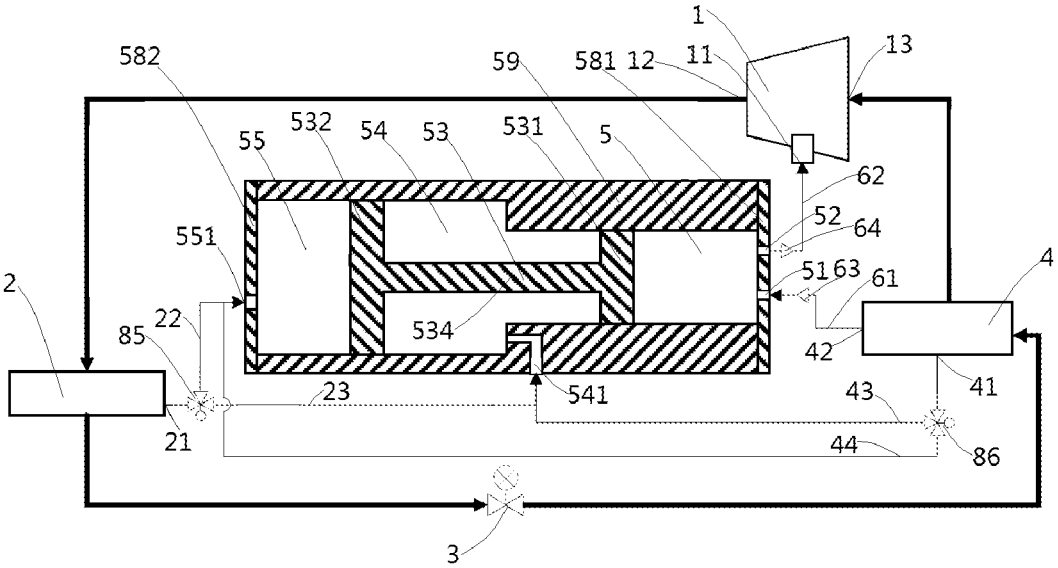
FIG. 3 shows a schematic structural view of a refrigeration system according to another embodiment of the present disclosure.
Figure 4:
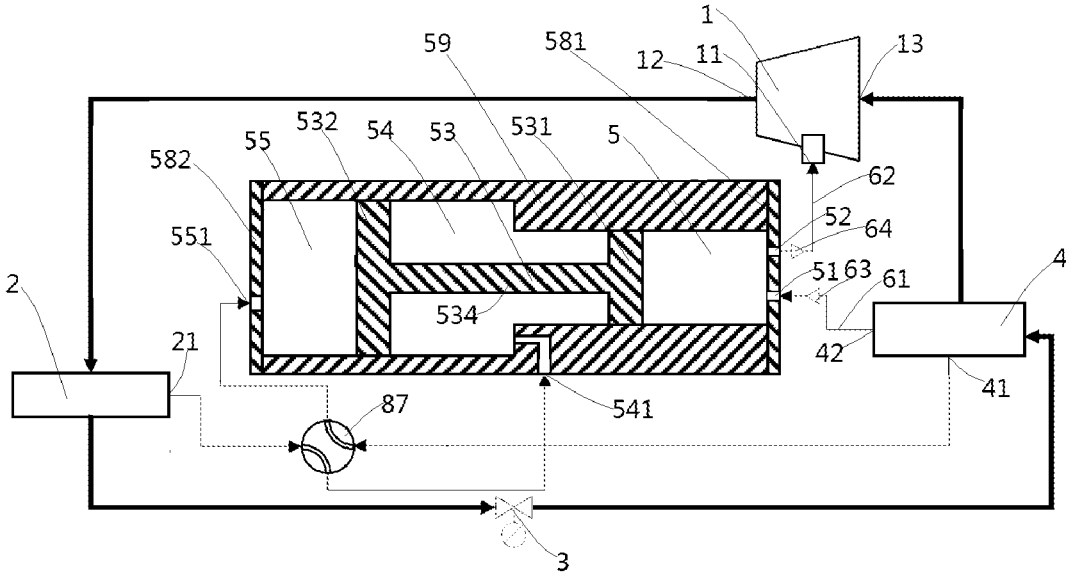
FIG. 4 shows a schematic structural view of a refrigeration system according to another embodiment of the present disclosure.

Now with continued reference to FIGS. 2 to 4, some modifications of the refrigeration system according to the embodiments of the present disclosure will be introduced. In the structure of FIG. 2, instead of the electric actuator 91, two streams of fluid with a pressure difference are used to drive the main piston 531. Specifically, the main piston 531 is connected to a first side of a control piston 532 through the connecting rod 534. The first side of the control piston 532 has a first control chamber 54, and a second side of the control piston 532 has a second control chamber 55. The main piston 531, the connecting rod 534 and the control piston 532 form an entirety, which is referred to as a piston assembly 53. The first control chamber 54 and the second control chamber 55 are alternatively connected to a first pressure fluid source and a second pressure fluid source. The first pressure fluid source and the second pressure fluid source have a sufficient pressure difference, thereby driving the control piston 532 and the main piston 531 (i.e., the piston assembly 53) to reciprocate together so as to perform the extraction stroke and the discharge stroke. More specifically, for example, in the extraction stroke, the first pressure fluid source with a larger pressure is communicated to the first control chamber 54, and the second pressure fluid source is communicated to the second control chamber 55, so that the control piston 532 drives the main piston 531 to move toward the left together to extract the oil-containing refrigerant from the evaporator 4 to the operation chamber 5. In the discharge stroke, the first pressure fluid source with a larger pressure is communicated to the second control chamber 55, and the second pressure fluid source is communicated to the first control chamber 54, so that the control piston 532 drives the main piston 531 to move toward the right together to discharge the oil-containing refrigerant from the operation chamber 5 to the bearing chamber or bearing lubrication pipeline 11 of the compressor. In the illustrated embodiment, the operation chamber 5, the first control chamber 54 and the second control chamber 55 are defined by the same cylinder 59, which includes a portion with a smaller cross section at an end close to the operation chamber 5 and a portion with a larger cross section at an end close to the second control chamber. The end of the cylinder 59 close to the operation chamber 5 is covered by a first cylinder head 581, on which the first port 51 and the second port 52 are provided, and the end of the cylinder 59 close to the second control chamber is covered by a second cylinder head 582. The first control chamber 54 is located between a back side of the main piston 531 and the first side of the control piston 532, and the control piston 532 has a larger area of action (action area of fluid pressure) than the main piston 531. In the extraction stroke and the discharge stroke, the main piston 531 is always located in the portion of the cylinder with the smaller cross section, and the control piston 532 is always located in the portion of the cylinder with the larger cross section. In an alternative embodiment, the operation chamber 59, the first control chamber 54 and the second control chamber 55 may be separated and defined by different cylinders, and the first control chamber 54 may also not be communicated to the back side of the main piston 531. The first pressure fluid source and the second pressure fluid source may be selected from any position in the refrigeration system, as long as the first pressure fluid source and the second pressure fluid source have a sufficient pressure difference. Alternatively, the first pressure fluid source and the second pressure fluid source may also be external fluid sources independent from the refrigeration system itself. In the illustrated embodiment, the first pressure fluid source is from the evaporator 4, and the second pressure fluid source is from the condenser 2. Specifically, an additional port 21 of the condenser 2 is communicated to a port 551 of the second control chamber 55 through a first pipeline 22 of the condenser, and is communicated to a port 541 of the first control chamber 54 through a second pipeline 23 of the condenser. The first pipeline 22 of the condenser and the second pipeline 23 of the condenser are respectively provided with a first control valve 81 and a second control valve 82. On the other hand, an additional port 41 of the evaporator 4 is communicated to the port 541 of the first control chamber 54 through a first pipeline 43 of the evaporator, and is communicated to the port 551 of the second control chamber 55 through a second pipeline 44 of the evaporator. The first pipeline 43 of the evaporator and the second pipeline 44 of the evaporator are respectively provided with a third control valve 83 and a fourth control valve 84. The first control valve 81, the second control valve 82, the third control valve 83, and the fourth control valve 84 communicate with a controller. The controller is configured to open the second control valve 82 and the fourth control valve 84 and close the first control valve 81 and the third control valve 83 during the extraction stroke, thereby introducing the fluid in the condenser 2 into the first control chamber 54 and introducing the fluid in the evaporator 4 into the second control chamber 55, which therefore drives the piston assembly 53 composed of the main piston 531, the connecting rod 534 and the control piston 532 to move toward the left. The controller is also configured to open the first control valve 81 and the third control valve 83 and close the second control valve 82 and the fourth control valve 84 during the discharge stroke, thereby introducing the fluid in the condenser 2 into the second control chamber 55 and introducing the fluid in the evaporator 4 into the first control chamber 54, which therefore drives the piston assembly 53 to move toward the right. The above process is repeated again and again.

With continued reference to FIG. 3, this embodiment differs from the embodiment shown in FIG. 2 in that two three-way valves 85 and 86 are used to replace the four control valves in FIG. 2. Specifically, the evaporator 4 is connected to the first control chamber 54 and the second control chamber 55 respectively through a first three-way valve 86, and the condenser 2 is connected to the first control chamber 54 and the second control chamber 55 respectively through a second three-way valve 85. The first three-way valve 86 and the second three-way valve 85 communicate with the controller. In the extraction stroke, the first three-way valve 86 is adjusted to communicate the evaporator 4 with the second control chamber 55, and the second three-way valve 85 is adjusted to communicate the condenser 2 with the first control chamber 54. In the discharge stroke, the first three-way valve 86 is adjusted to communicate the evaporator 4 with the first control chamber 54, and the second three-way valve 85 is adjusted to communicate the condenser 2 with the second control chamber 55.

With continued reference to FIG. 4, this embodiment differs from the embodiment shown in FIG. 2 in that a four-way valve 87 is used to replace the four control valves in FIG. 2. Specifically, the evaporator 4, the condenser 2, the first control chamber 54 and the second control chamber 55 are connected by the four-way valve 87. In the extraction stroke, the four-way valve 87 is adjusted to communicate the evaporator 4 with the second control chamber 55 and communicate the condenser 2 with the first control chamber 54. In the discharge stroke, the four-way valve 87 is adjusted to communicate the evaporator 4 with the first control chamber 54 and communicate the condenser 2 with the second control chamber 55.

In some embodiments, the refrigeration system further includes: a sensor, which is configured to sense the position of the control piston 532 or the main piston 531; and a controller communicating with the sensor, in which the controller is configured to operate at least one valve (e.g., the control valves 81, 82, 83 and 84 in the embodiment of FIG. 2, or the three-way valves 85 and 86 in the embodiment of FIG. 3, or the four-way valve 87 in the embodiment of FIG. 4) based on the position of the control piston 532 or the main piston 531 provided by the sensor so that the first control chamber and the second control chamber are alternatively connected to the first pressure fluid source and the second pressure fluid source, thereby performing the extraction stroke and the discharge stroke. Various types of proximity sensors or contact sensors may be used as the sensor; for example, optical sensors, magnetic sensors and the like may be used. The sensor may be, for example, mounted on the cylinder wall, on the end cover and/or on the piston assembly 53.

Figure 5:
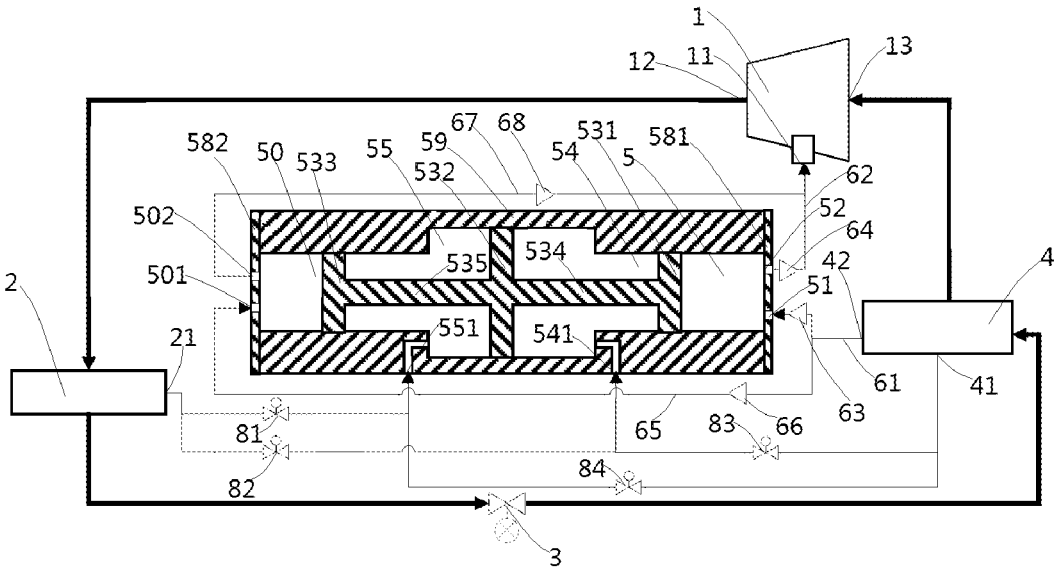
FIG. 5 shows a schematic structural view of a refrigeration system according to another embodiment of the present disclosure.

With continued reference to FIG. 5, another embodiment of the refrigeration system will be introduced. In the embodiment shown in FIG. 5, the oil recovery system further includes an additional operation chamber 50. The additional operation chamber 50 includes a third port 501 that communicates with the oil-containing position (taking the evaporator 4 as an example) in the refrigeration system through a third pipeline 65, and a fourth port 502 that communicates with the bearing chamber or bearing lubrication pipeline 11 of the compressor through a fourth pipeline 67. Similarly, a third one-way valve 66 is provided on the third pipeline 65 or the third port 501, and third one-way valve 66 only allows for a flow of fluid from the evaporator 4 to the additional operation chamber 50. A fourth one-way valve 68 is provided on the fourth pipeline 67 or the fourth port 502, and the fourth one-way valve 68 only allows for a flow of fluid from the additional operation chamber 50 to the bearing chamber or bearing lubrication pipeline 11 of the compressor. The additional operation chamber 50 has an additional main piston 533, which is connected to the second side of the control piston 532 through a connecting rod 535, and the second control chamber 55 is located between the back side of the additional main piston 50 and the second side of the control piston 532. In the illustrated embodiment, the cylinder 59 defines portions with a smaller cross section at both ends and a portion with a larger cross section in the middle. The cylinder 59 is covered by the first cylinder head 581 and the second cylinder head 582 at both ends, and the second cylinder head 582 includes a first port 501 and a second port 502. In the extraction stroke and the discharge stroke, the main piston 531 and the additional main piston 533 move in the portions with the smaller cross section at both ends of the cylinder, and the control piston 532 moves in the portion with the larger cross section in the middle. The control piston 532 has a larger area of action (i.e., cross-sectional area) than the main piston 531 and the additional main piston 533. In the illustrated embodiment, the main piston 531 has substantially the same area of action as the additional main piston 533. With this arrangement, when the main piston 531 is performing the extraction stroke, the additional main piston 533 performs the discharge stroke to deliver the oil-containing refrigerant from the additional operation chamber 50 to the bearing chamber or bearing lubrication pipeline 11 of the compressor; and when the main piston 531 is performing the discharge stroke, the additional main piston 533 performs the extraction stroke to extract the oil-containing refrigerant in the oil-containing position in the refrigeration system to the additional operation chamber 50. Therefore, unlike the structures of FIGS. 1 to 4 in which the oil-containing refrigerant is delivered to the bearing chamber or bearing lubrication pipeline 11 of the compressor only during the discharge stroke, in the embodiment shown in FIG. 5, the oil-containing refrigerant will be continuously delivered to the bearing chamber or bearing lubrication pipeline 11 of the compressor.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. Therefore, it should be understood that these modifications or changes should be included within the scope of protection of the present disclosure.

What is claimed is:

1. A refrigeration system, comprising: a compressor, a condenser, a throttling device, and an evaporator, all of which are connected in sequence to form a cooling circuit, wherein the refrigeration system further comprises an oil recovery system comprising:

an operation chamber, which comprises a first port communicating with an oil-containing position in the refrigeration system through a first pipeline, and a second port communicating with a bearing chamber or a bearing lubrication pipeline of the compressor through a second pipeline; and a main piston in the operation chamber, the main piston reciprocating in the operation chamber to perform an extraction stroke and a discharge stroke; wherein in the extraction stroke, an oil-containing refrigerant in the oil-containing position in the refrigeration system is extracted to the operation chamber; and in the discharge stroke, the oil-containing refrigerant in the operation chamber is delivered to the bearing chamber or the bearing lubrication pipeline of the compressor;

wherein the main piston is connected to a first side of a control piston through a connecting rod, there is a first control chamber at the first side of the control piston, and a second control chamber at a second side of the control piston; the first control chamber and the second control chamber are alternatively connected to a first pressure fluid source and a second pressure fluid source, and there is a pressure difference between the first pressure fluid source and the second pressure fluid source, thereby driving the control piston to reciprocate together with the main piston to perform the extraction stroke and the discharge stroke;

wherein the first pressure fluid source is from the evaporator, and the second pressure fluid source is from the condenser.

2. The refrigeration system according to claim 1, wherein a first one-way valve that only allows a fluid to flow from the oil-containing position to the first port is provided on the first pipeline or on an end cover at an end of the operation chamber, and a second one-way valve that only allows the fluid to flow from the second port to the bearing chamber or the bearing lubrication pipeline of the compressor is provided on the second pipeline or the end cover.

3. The refrigeration system according to claim 1, wherein the oil-containing position in the refrigeration system is in an oil-collecting cavity inside the compressor or in the evaporator.

4. The refrigeration system according to claim 1, wherein the main piston is driven by an electric actuator.

5. The refrigeration system according to claim 1, wherein the first control chamber is located between a back side of the main piston and the first side of the control piston, and the control piston has a larger area of action than the main piston.

6. The refrigeration system according to claim 1, wherein:

the evaporator is connected to the first control chamber through a first valve and is connected to the second control chamber through a second valve, and the condenser is connected to the first control chamber through a third valve and is connected to the second control chamber through a fourth valve; or the evaporator is connected to the first control chamber and the second control chamber respectively through a first three-way valve, and the condenser is connected to the first control chamber and the second control chamber respectively through a second three-way valve; or the evaporator, the condenser, the first control chamber and the second control chamber are connected through a four-way valve.

7. The refrigeration system according to claim 6, wherein the refrigeration system further comprises:

a sensor, which is configured to sense a position of the control piston or the main piston; and a controller in communication with the sensor, which is configured to operate at least one valve based on the position of the control piston or the main piston provided by the sensor so that the first control chamber and the second control chamber are alternatively connected to the first pressure fluid source and the second pressure fluid source.

8. A refrigeration system, comprising: a compressor, a condenser, a throttling device, and an evaporator, all of which are connected in sequence to form a cooling circuit, wherein the refrigeration system further comprises an oil recovery system comprising:

an operation chamber, which comprises a first port communicating with an oil-containing position in the refrigeration system through a first pipeline, and a second port communicating with a bearing chamber or a bearing lubrication pipeline of the compressor through a second pipeline; and a main piston in the operation chamber, the main piston reciprocating in the operation chamber to perform an extraction stroke and a discharge stroke; wherein in the extraction stroke, an oil-containing refrigerant in the oil-containing position in the refrigeration system is extracted to the operation chamber; and in the discharge stroke, the oil-containing refrigerant in the operation chamber is delivered to the bearing chamber or the bearing lubrication pipeline of the compressor;

wherein the main piston is connected to a first side of a control piston through a connecting rod, there is a first control chamber at the first side of the control piston, and a second control chamber at a second side of the control piston; the first control chamber and the second control chamber are alternatively connected to a first pressure fluid source and a second pressure fluid source, and there is a pressure difference between the first pressure fluid source and the second pressure fluid source, thereby driving the control piston to reciprocate together with the main piston to perform the extraction stroke and the discharge stroke;

wherein the first control chamber is located between a back side of the main piston and the first side of the control piston, and the control piston has a larger area of action than the main piston;

wherein the oil recovery system further comprises an additional operation chamber, and the additional operation chamber comprises a first port communicating with the oil-containing position in the refrigeration system through a third pipeline, and a second port communicating with the bearing chamber or the bearing lubrication pipeline of the compressor through a fourth pipeline; and an additional main piston in the additional operation chamber, wherein the additional main piston is connected to the second side of the control piston through a connecting rod, the second control chamber is located between a back side of the additional main piston and the second side of the control piston, and the control piston has a larger area of action than the additional main piston; when the main piston is performing the extraction stroke, the additional main piston performs the discharge stroke to deliver the oil-containing refrigerant from the additional operation chamber to the bearing chamber or the bearing lubrication pipeline of the compressor, and when the main piston is performing the discharge stroke, the additional main piston performs the extraction stroke to extract the oil-containing refrigerant in the oil-containing position in the refrigeration system to the additional operation chamber.

* * * * *